United States Patent [19]

Meikle

[11] Patent Number: 4,488,425

[45] Date of Patent: Dec. 18, 1984

[54] BENDING TOOL

[76] Inventor: David Meikle, 14 Paradise Rd., Burpengary, Queensland, Australia, 4505

[21] Appl. No.: 395,052

[22] PCT Filed: Oct. 28, 1981

[86] PCT No.: PCT/AU81/00155

§ 371 Date: Jun. 16, 1982

§ 102(e) Date: Jun. 16, 1982

[87] PCT Pub. No.: WO82/01486

PCT Pub. Date: May 13, 1982

[30] Foreign Application Priority Data

Oct. 28, 1980 [AU] Australia ..... PE241

[51] Int. Cl.[3] ..... B21D 31/00

[52] U.S. Cl. ..... 72/389; 72/450; 72/482; 72/409; 81/363; 81/126

[58] Field of Search ..... 72/389, 410, 450, 482, 72/409; 81/355, 362, 363, 126

[56] References Cited

U.S. PATENT DOCUMENTS

| | | | |
|---|---|---|---|
| 497,116 | 5/1893 | Brown | 72/389 |
| 2,763,171 | 9/1956 | Modrey et al. | 72/410 |
| 2,914,976 | 12/1959 | Demler | 72/450 |
| 3,031,001 | 4/1962 | Stoltz | 81/362 |
| 3,034,385 | 5/1962 | Hester | 72/389 |
| 3,456,467 | 7/1969 | Hogarth | 72/389 |
| 3,822,578 | 1/1973 | Le Breton | 72/389 |
| 4,077,249 | 1/1976 | Schmitter | 72/389 |

FOREIGN PATENT DOCUMENTS

| | | |
|---|---|---|
| 109669 | 2/1940 | Australia . |
| 2824074 | 2/1979 | Fed. Rep. of Germany . |
| 880920 | 4/1943 | France . |
| 1251546 | 10/1971 | United Kingdom . |
| 2020586 | 11/1979 | United Kingdom . |

*Primary Examiner*—Daniel C. Crane
*Assistant Examiner*—David B. Jones
*Attorney, Agent, or Firm*—Cushman, Darby & Cushman

[57] ABSTRACT

A bending tool for bending elongate members. The bending tool includes a support (**12*a*/28) such as a support frame (28) for supporting the elongate member (40) and also includes a bending member (15*a*/32/34) such as a pusher member (15*a*) whereby the bending member (15*a*/32/34 may abut the elongate member (40). When either the bending member (15*a*/32/34) or support member (12*a*/28) is moved relative to the other this may cause bending of the elongate member (40). The bending tool also includes actuating members (10*a*/22*a*) for causing said relative movement between the support member (12*a*/28) and the bending member (15*a*/32/34**).

5 Claims, 6 Drawing Figures

BENDING TOOL

This invention relates to a bending tool which is especially adapted for the bending of elongate members such as fence cross members.

Hitherto the bending of relatively rigid members such as cross members of fences (e.g. wires) has been difficult to achieve on a systematic and orderly basis. While previous methods have been attempted they have mainly utilized the aid of bending machines such as those used for bending rigid lengths of pipe which are utilized as reinforcement members in the formation of concrete structures. Such bending machines however are bulky, expensive and entirely inappropriate for forming curved structures such as curved fences or frameworks on a manual basis.

It is therefore an object of the invention to provide a bending tool which may be utilized to quickly and efficiently form curved structures.

The bending tool of the invention includes:

support means;

bending means; and, actuating means for actuation of the bending means which is movable relative to the support means or vice versa.

The support means may include a housing or supporting frame or plate for the bending means but most desirably includes a rigid frame including a pair of spaced parallel side members and optionally one or intermediate cross members. There also is suitably included an end cross member or intermediate cross member which functions as an abutment block and may include a recess which may accommodate portion of the bending means in use and wherein the elongate member being bent is sandwiched therebetween.

The bending means may include a pusher member which may be actuated so that it may bear against the elongate member to bend same. Suitably the pusher member may include a pushrod or pusher block which is movable relative to the above mentioned support frame. The pusher block is suitably slidably mounted on the rigid support frame. Thus the pusher member may be mounted on slideways or slide grooves on the rigid frame. However, this is not necessary and the pusher member may be suitably spaced from the rigid support frame and movable thereto between the pair of spaced side frame members.

In another arrangement the pusher block may remain stationary and the support frame moved relative thereto upon actuation of the actuating means to bend the elongate member.

The actuating means in one form may include a pair of elongate handles which are similar to bolt cutter handles which may be widely spaced apart when the handles are in their open position.

Each opposed handle is suitably of substantial length and is similar to a bolt cutter handle as described above so as to provide a considerable amount of thrust in actuation of the bending means.

At its end which is proximal to the bending means each handle may include a toggle plate or other suitable connecting member which is pivotally attached to the handle or forward extension thereof and also to an associated portion of a respective side member of the rigid frame.

Reference is now made to a preferred embodiment of the invention as shown in the accompanying drawings wherein.

Figure 2:
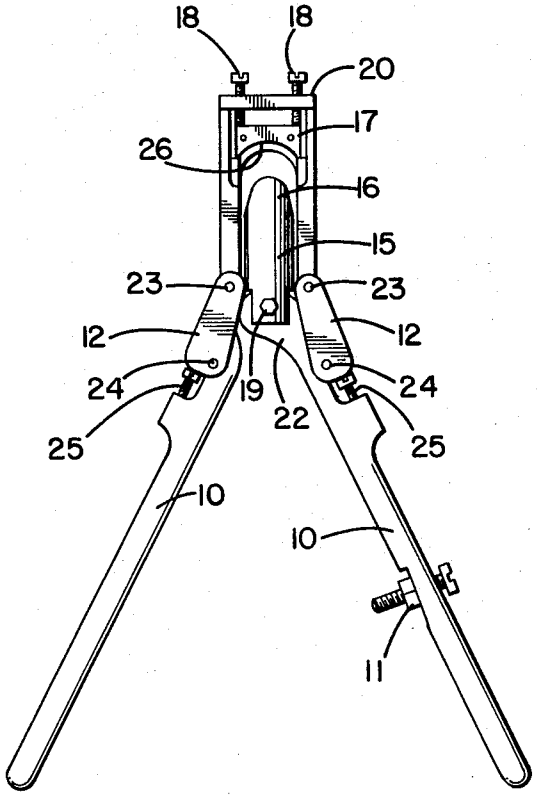
FIG. 2 is a top plan view of the bending tool shown in FIG. 1 in the open position.

In the drawings, the bending tool shown includes opposed handles 10, adjustable stops 11, toggle connectors 12 interconnecting each handle 10 to rigid frame 13 comprising opposed parallel side members 14. Frame 15 also includes an abutment block or intermediate cross member 17. There is also shown pusher member 15 having a tapered end surface 16 as shown and being pivotally attached to the inner end portions of each handle 10 at 24. Toggles 12 are pivotally attached to a respective side frame member 14 at 23.

One handle 10 has an inward extension 22 which is pivotally attached to pusher member 15 at 19. There is also shown end cross member or end plate 20 of frame 13 which may be moved relative to frame 13 by adjustment screws 18 as is the case with abutment block 17 which has arcuate recess 26 for engaging with tapered end surface 16 of the pusher member 15 in the closed position. There is also shown adjustment screws 25 for adjustably mounting toggles 12.

Figure 1:
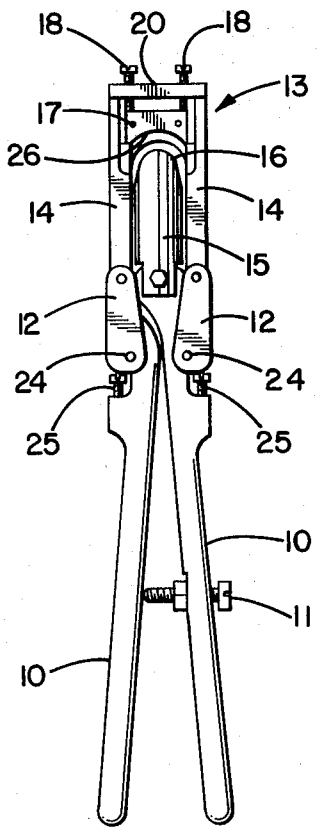
FIG. 1 is a top plan view of the bending tool in the closed position.
Figure 3:
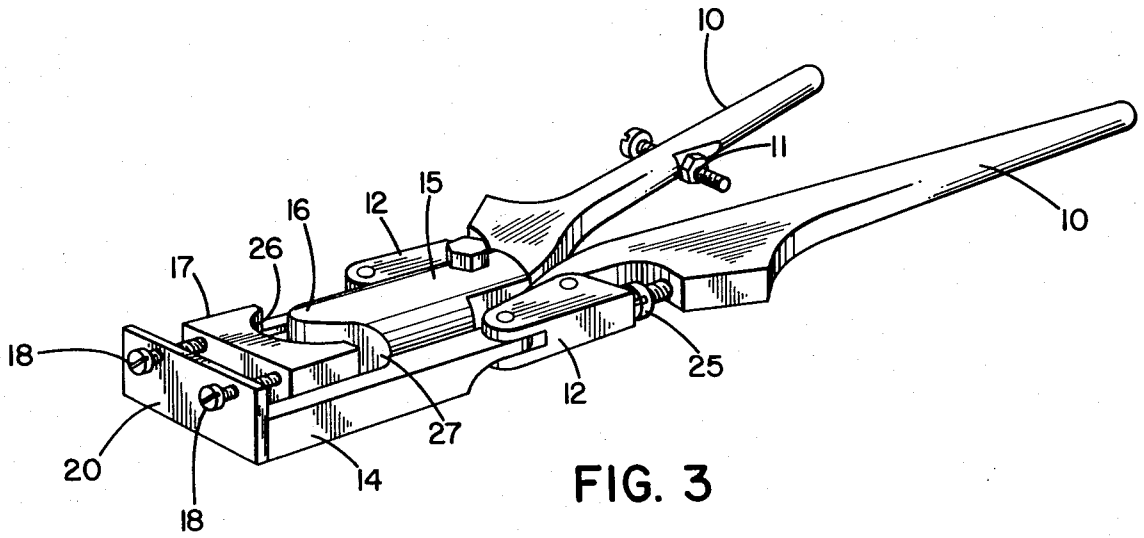
FIG. 3 is a perspective view of the bending tool shown in FIG. 1.

As shown in FIGS. 1–12, the bending tool upon movement of handles 10 from an open position as shown in FIG. 2 to a closed position as shown in FIG. 1 may bend an elongate member such as metal rod or wire (not shown) wherein the elongate member is interposed between tapered end surface 16 and arcuate recess 26 of abutment block 17. An elongate member (not shown) may be inserted through opposed gaps 27 in the frame 13 and be retained therein before actuation of pusher member 15 which is moved toward frame 13 as shown by pivoting movement of toggles 12 which in turn is caused by inward movement of handles 10.

Figure 4:
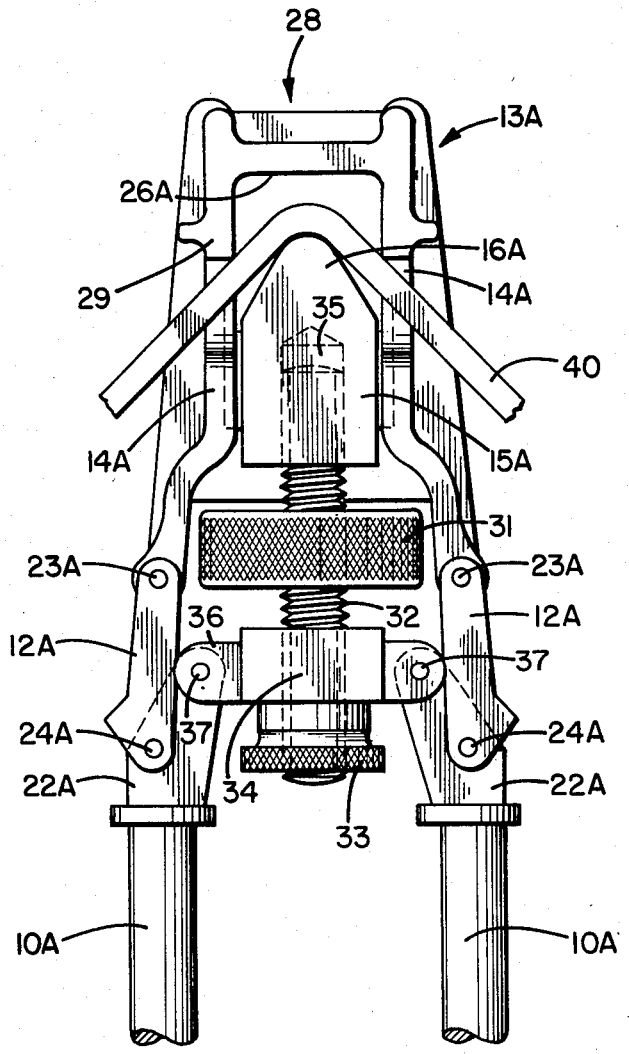
FIG. 4 is a top plan view of an alternative type of bending tool to that shown in FIG. 1 and being illustrated in the closed position.
Figure 5:
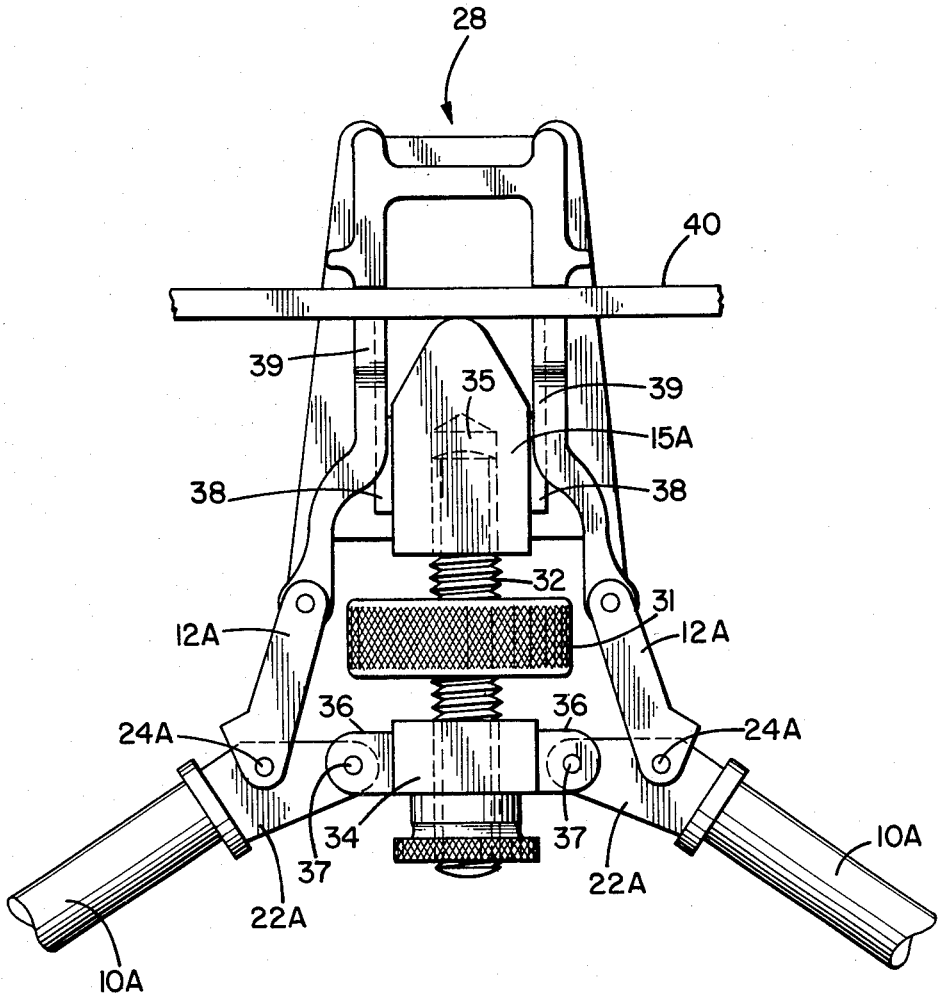
FIG. 5 is a top plan view of the bending tool of FIG. 4 in the open position; and, FIG. 6 is a perspective view of the bending tool of FIG. 4.
Figure 6:
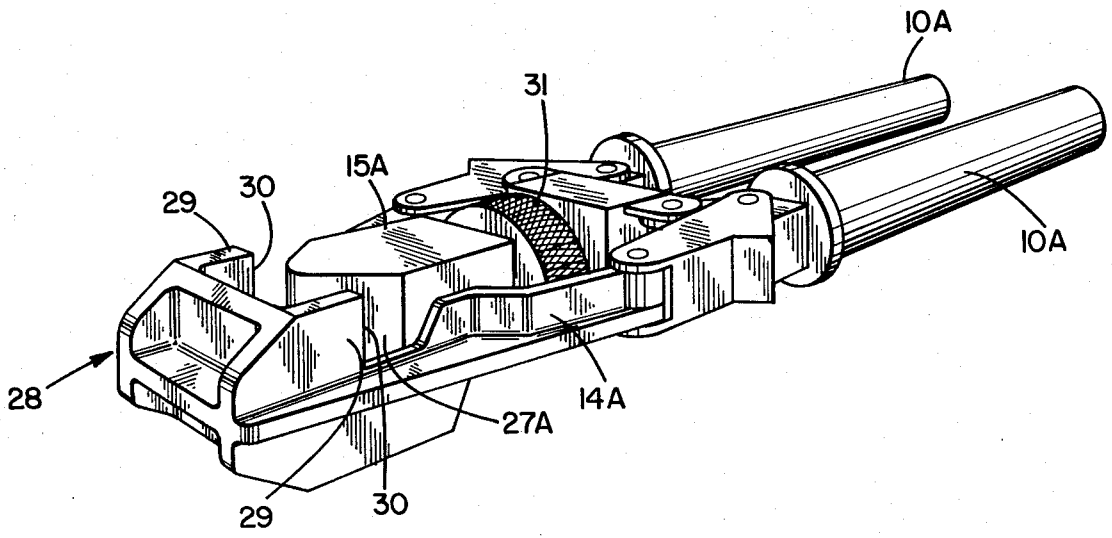

In the embodiment shown in FIGS. 4–6 there is shown opposed handles **10*a*, toggle connectors 12*a* interconnecting forward extensions 22*a* of handles 10*a* to side frame members 14*a* of support frame 28. Toggle connectors 12*a* are pivotally attached to each extension 22*a* at 24*a* and pivotally attached to each side frame member 14*a* at 23*a*. There is also included a shaft 32 having a support member 34 mounted thereon which has lateral extensions or ears 36. Forward extensions 22*a* of each handle 10*a* are pivotally mounted to a respective ear 36 at 37**.

Shaft 32 is provided with a locknut 33 as shown and also with an adjusting nut 31 which is integral with shaft 32. Shaft 32 is received in a recess or socket 35 of pusher member **15*a* and may be used to adjust the position of pusher member 15*a* relative to frame 28 so as to provide for different thicknesses of elongate member 40** which may be bent by the bending tool of the invention.

Pusher member **15*a* is provided with opposed lateral extensions 38 which engage in supporting grooves 39**

(shown in dotted outline in FIGS. 4–5) in side members 14*a*.

As best shown in FIG. 6, frame 28 includes upward extensions 29 of each side frame 14*a* having abutment surfaces 30. There is provided opposed gaps 27*a* through which an elongate rod 40 may be inserted before being bent by pusher member 15*a*. Pusher member 15*a* has tapered end surface 16*a* which engages in recess 26*a* of frame 28 in the closed position. The elongate member 40 is interposed between abutment surfaces 30 and pusher member 15*a* in the open position as shown in FIG. 5 and is bent as shown.

As shown in FIGS. 4–6 toggle connectors 12*a* are pivoted inwardly by inward movement of handles 10 causing longitudinal movement of shaft 32 and pusher member 15*a*.

It will also be appreciated that instead of inward movement of said handle to cause relative movement between said pusher member and the support frame that in a variation of the embodiments described above the relative movement may be caused by outward movement of each handle away from each other.

I claim:

1. A bending tool for bending elongate members including;

an elongated support frame;

an abutment block attached to said support frame;

a pusher member movably mounted to the support frame, said pusher member having a working end surface and a mounting end having a mating bore;

a pair of opposed recesses, for positioning a workpiece transversely with respect to the support frame, located on opposite sides of the support frame;

a pair of handles;

linkage means interconnecting each handle to the support frame;

a longitudinal shaft screw threadedly mounted in said mating bore and extending parallel to the length of the support frame whereby said pusher member is adjustably movable, by said shaft screw, relative to the abutment block;

pivot means interconnecting said shaft screw to each of said handles; and locking means for selectively locking the shaft screw against movement in a selected position in the mating bore of the pusher member;

the construction and arrangement being such that upon movement of said handles toward and away from each other said pusher block moves longitudinally with respect to said support frame relative to the abutment block and when an elongate member is located in said recesses and transversely of the support frame and interposed between the pusher member and the abutment block said longitudinal movement of the pusher member bends said elongate member and upon release of said locking means said pusher member may be adjustably moved on said shaft relative to the abutment block.

2. A bending tool as claimed in claim 1, wherein the support frame includes a pair of opposed side members and said pusher block is mounted in opposed grooves wherein each groove is located in a respective side member.

3. A bending tool as claimed in claim 1, wherein the pusher member has a leading end proximal to the abutment block of substantially conical or tapered shape which locates in a recess in the abutment block upon actuating movement of said handles.

4. A bending tool as claimed in claim 1, wherein said abutment block is integral with said support frame.

5. A bending tool as claimed in claim 1, wherein said linkage means includes a pair of opposed toggle connectors connecting a respective handle to said support means.

* * * * *